US005287080A

United States Patent [19]

Linton et al.

[11] Patent Number: 5,287,080

[45] Date of Patent: Feb. 15, 1994

[54] BLOWN FUSE INDICATOR

[75] Inventors: John C. Linton, Potomac; William Gingras, Friendship, both of Md.

[73] Assignee: FIC Corporation, Rockville, Md.

[21] Appl. No.: 62,208

[22] Filed: May 18, 1993

[51] Int. Cl.[5] ..... H01H 85/32; H01H 85/143

[52] U.S. Cl. ..... 337/242; 337/241; 337/252

[58] Field of Search ..... 337/241, 242, 248, 251, 337/252, 265, 266, 268

[56] References Cited

U.S. PATENT DOCUMENTS 3,794,948 2/1974 Linton ..... 337/242

*Primary Examiner*—Harold Broome

*Attorney, Agent, or Firm*—Brady, O'Boyle & Gates

[57] ABSTRACT

A blown fuse indicator for a cartridge fuse wherein conductive brackets are mounted between electrical insulating end caps and the ends of a tube housing a lamp and associated resistors. Each conductive bracket includes a disc portion having a polygonal aperture for receiving a sleeve integral with the cap, the sleeve having a polygonal cross-sectional configuration corresponding to the disc aperture. The free ends of the lamp and resistor leads extend through the disc portion of the conductive bracket and are pressed and gripped between the cap and conductive bracket. The conductive bracket also includes a blade portion which may have a planar surface, a corrugated surface or a reversely bent portion to provide direct and positive contact with the end walls of the fuse ferrules, whether they be flat, concave or convex.

8 Claims, 1 Drawing Sheet

FIG.1
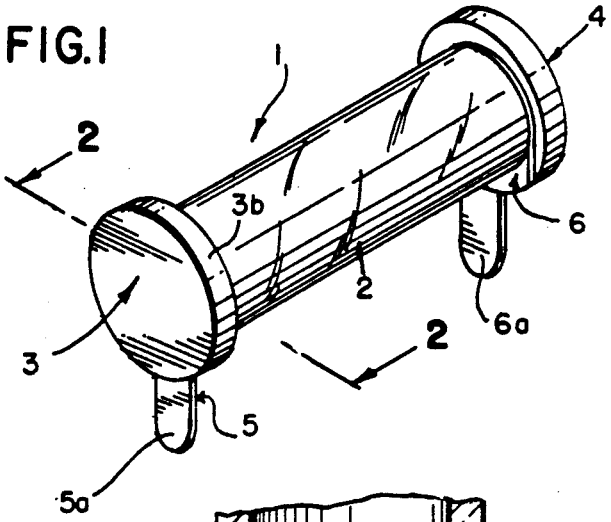
FIG.2
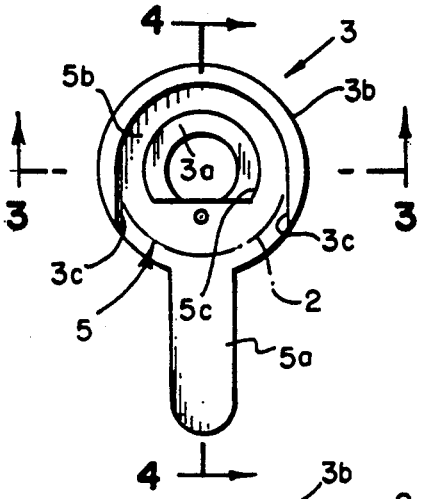
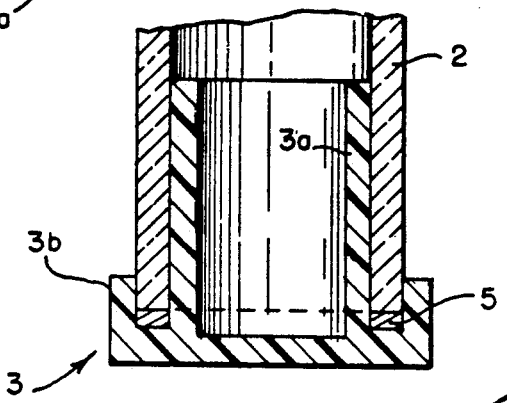
FIG.3
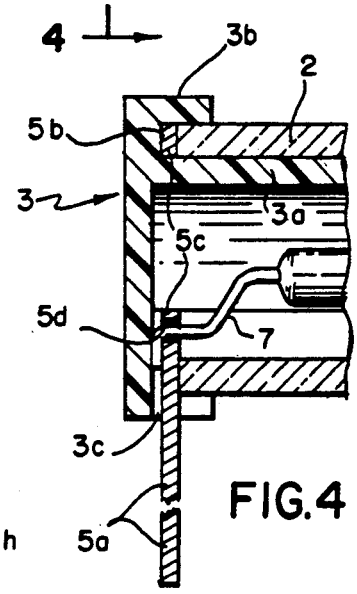
FIG.4
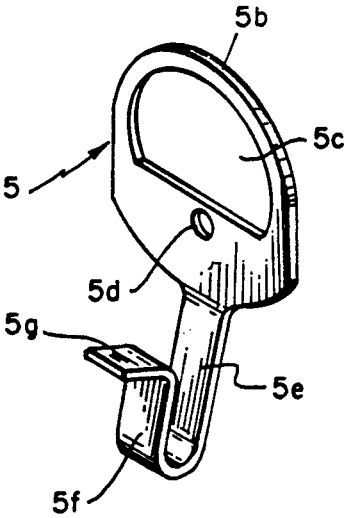
FIG.5
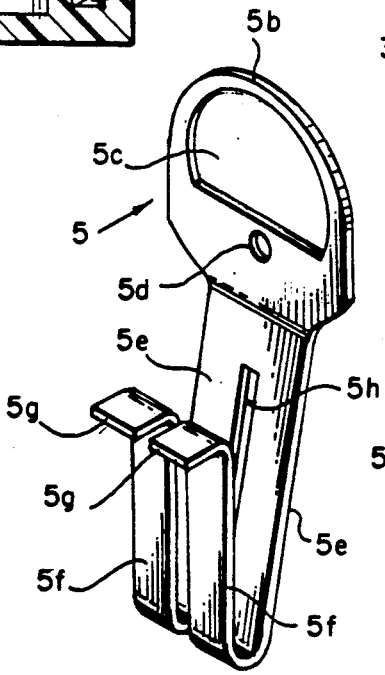
FIG.6
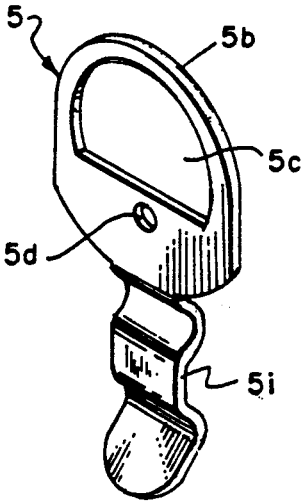
FIG.7

BLOWN FUSE INDICATOR

BACKGROUND OF THE INVENTION

The blown fuse indicator of the present invention is of the type disclosed in U.S. Pat. No. 3,794,948 dated Feb. 26, 1974, and owned by the same assignee as the instant application, wherein a lamp and associated resistors are housed within a translucent tube having contact terminals at each end thereof to which electrically conductive brackets are secured for engagement with the end surfaces of the ferrules on each end of a cartridge fuse, whereby the indicator is supported on the fuse cartridge. By this construction and arrangement, when the fuse blows, the lamp glows to indicate that the fuse has blown.

While these fuse indicators have been satisfactory for their intended purpose, they have required many connection steps and parts in their manufacture. For instance, the blown fuse indicator disclosed in the above-mentioned patent requires a screw to secure the contact terminal to the translucent tube, a rivet for securing the conductive bracket to the contact terminal, and a boot or cap to cover the exposed conductive parts on each end of the indicator.

SUMMARY OF THE INVENTION

After considerable research and experimentation, the blown fuse indicator of the present invention has been devised which requires fewer parts than similar prior art indicators. It is solderless, and the blade portion of the conductive bracket is provided with an improved configuration to thereby provide direct and positive contact with the end walls of the fuse ferrules whether they be flat, concave or convex.

The blown fuse indicator of the present invention comprises, essentially, a lamp and associated resistors housed within a translucent tube. Each end of the tube is closed by an end cap of insulating material having an integral sleeve portion extending axially therefrom into the tube and engaging the inner wall surface thereof. The cap is also provided with an integral outer annular flange portion concentric with the sleeve and extending over a portion of the outer peripheral wall surface of the tube. The conductive bracket is formed with a disc portion having a semi-circular aperture through which the cap sleeve extends. The sleeve has a cross-sectional configuration corresponding to the semi-circular aperture of the disc portion of the conductive bracket, whereby the conductive bracket is fixedly mounted on the cap and associated sleeve, to thereby preclude the necessity of employing a rivet for securing the conductive brackets to a contact terminal.

The conductive leads from the resistor and lamp at each end of the tube are inserted through a small hole provided in the disc portion of each conductive bracket and the free end portions of the respective leads are pressed between the end cap and the disc portion of the conductive bracket, to thereby preclude the use of solder for connecting the resistor leads and lamp leads to their respective conductive bracket.

By mounting the conductive bracket between the end of the tube and the end cap, the conductive parts are covered to thereby preclude the necessity of a boot.

While the blade portion of the conductive bracket may be planar, it can be corrugated or configured into reversely bent portions, which may be bifurcated, to thereby provide direct and positive contact with the end walls of the fuse ferrules whether they be flat, concave or convex.

BRIEF DESCRIPTION OF THE DRAWINGS

FIG. 1 is a perspective view of the blown fuse indicator of the present invention showing one embodiment of the blade portion of the conductive bracket;

FIG. 2 is a view taken along line 2—2 of FIG. 1;

FIG. 3 is a view taken along line 3—3 of FIG. 2;

FIG. 4 is a view taken along line 4—4 of FIG. 2;

FIG. 5 is a perspective view of another embodiment of the blade portion of the conductive bracket;

FIG. 6 is a perspective view of still another embodiment of the blade portion of the conductive bracket; and FIG. 7 is a perspective view of yet another embodiment of the blade portion of the conductive bracket.

DESCRIPTION OF THE PREFERRED EMBODIMENT

Referring to the drawing and more particularly to FIG. 1, the blown fuse indicator 1 of the present invention comprises a translucent tube 2 housing a lamp and associated resistors, not shown. Each end of the tube 2 is closed by end caps 3 and 4 of insulating material, and conductive brackets 5 and 6 are mounted between the ends of the tube 2 and the caps 3 and 4. As will be understood by those skilled in the art, the lamp and resistors enclosed within the tube 2 are electrically connected to the conductive brackets 5 and 6 having blade portions 5*a*, 6*a* which are adapted to engage the end surfaces of the ferrules on each end of a cartridge fuse, whereby the indicator 1 is supported on the fuse cartridge. By this construction and arrangement, when the fuse blows, the lamp glows to indicate that the fuse has blown.

The details of the construction of end cap 3 and conductive bracket 5 are illustrated in FIGS. 2, 3 and 4, it being understood that end cap 4 and conductive bracket 6 are identical to cap 3 and bracket 5. End cap 3 has an integral sleeve portion 3*a* extending axially therefrom into the tube 2 and engaging the inner wall surface thereof. The cap 3 is also provided with an integral outer annular flange portion 3*b* concentric with the sleeve portion 3*a* and extending over a portion of the outer peripheral wall surface of the tube 2.

As will be seen in FIGS. 4 to 7, the conductive bracket 5 is formed with a disc portion 5*b* having a semi-circular aperture 5*c* through which the cap sleeve 3*a* extends. As will be seen in FIG. 2, the sleeve 3*a* has a cross-sectional configuration corresponding to the semi-circular aperture 5*c* of the conductive bracket, whereby the conductive bracket 5 is fixedly mounted on the cap 3 and associated sleeve 3*a*, to there-by obviate the necessity of employing a fastener for securing a conductive bracket to a contact terminal.

A small hole 5*d* is provided in the disc portion 5*b* of the conductive bracket 5 for receiving the free end portion of a resistor lead 7 (FIG. 4) which is pressed and bent downwardly in gripping engagement between the end cap 3 and disc portion 5*b* of the conductive bracket, to thereby preclude the use of solder for connecting the resistor leads and lamp leads to their respective conductive bracket.

The cap 3 can be fixed to the end of the tube 2 by a suitable adhesive or by welding which extends substantially 270° around the annular flange portion 3*b*. The remaining portion of the annular flange 3*b* is cut-away to form a slot 3*c* through which the depending blade 5*a* extends.

By mounting the conductive bracket 5 between the end of the tube 2 and the cap 3, the conductive parts between the bracket and the resistor lead are covered to thereby obviate the necessity of a boot to cover the end cap.

While the blade portion 5*a* of the conductive bracket 5 illustrated in FIGS. 1, 2 and 4 is planar, FIGS. 5, 6 and 7 show other blade configurations constructed and arranged to provide direct and positive contact with the end walls of a cartridge fuse ferrule, whether they be flat, concave or convex; thus, in FIG. 5, the conductive bracket is provided with an inclined blade portion 5*e* having a reversely bent portion 5*f* terminating in a tab portion 5*g*. FIG. 6 shows a similar arrangement; however, the blade is larger and bifurcated as at 5*h* to provide a pair of blade portions 5*e*, reversely bent portions 5*f* and tabs 5*g*; and in FIG. 7, the blade is corrugated as at 5*i*.

It is to be understood that the forms of the invention herewith shown and described are to be taken as preferred examples of the same, and that various changes in the shape, size and arrangement of parts may be resorted to, without departing from the spirit of the invention or scope of the subjoined claims.

We claim:

1. In a blown fuse indicator for a cartridge fuse wherein a lamp and associated resistors are housed within a tube, an end cap mounted on each end of said tube, and having an integral sleeve portion extending axially therefrom into the tube and engaging the inner wall surface thereof, and an integral outer annular flange portion provided on the cap concentric with the sleeve and extending over a portion of the outer peripheral wall surface of the tube, the improvement comprising a conductive bracket mounted at each end of the tube between the end of the tube and the cap, said conductive bracket being formed with a disc portion, an aperture provided in said disc portion, the cap sleeve extending through said aperture, said sleeve having a cross-section corresponding to the cross-section of said aperture, whereby the conductive bracket is fixedly mounted on the cap and associated sleeve, means for electrically connecting the resistor leads and lamp leads to the conductive brackets, and a depending blade integral with the disc portion of each conductive bracket adapted to engage a respective end wall of the cartridge fuse ferrule.

2. In a blown fuse indicator according to claim 1, wherein the end caps are made of electrical insulating material.

3. In a blown fuse indicator according to claim 1, wherein the aperture and corresponding cross-sectional configuration of the sleeve are semi-circular.

4. In a blown fuse indicator according to claim 1, wherein the means for electrically connecting the resistor leads and lamp leads to the conductive brackets comprises, a small hole provided in the disc portion of each conductive bracket, the free end portion of a resistor lead and a lamp lead extending through the hole in a respective bracket, the free end portions of the leads being pressed between the cap and disc portion of the conductive bracket and being gripped therebetween.

5. In a blown fuse indicator according to claim 1, wherein the depending blade has a planar surface.

6. In a blown fuse indicator according to claim 1, wherein the depending blade is provided with an inclined blade portion having a reversely bent portion terminating in a tab portion, to thereby provide direct and positive contact with the end walls of the cartridge ferrules, whether they be flat, concave or convex.

7. In a blown fuse indicator according to claim 6, wherein the blade is bifurcated to thereby provide a pair of inclined blade portions, a pair of reversely bent portions, and a pair of tab portions.

8. In a blown fuse indicator according to claim 1, wherein the blade has a corrugated surface.

* * * * *